US009688448B2

(12) United States Patent
Abegglen et al.

(10) Patent No.: US 9,688,448 B2
(45) Date of Patent: Jun. 27, 2017

(54) CLOSURE CAP WITH A MULTILAYER SEAL DISK FOR RECEPTACLES

(71) Applicant: NESTEC S.A., Vevey (CH)

(72) Inventors: Daniel Abegglen, Rances (CH); Berenice Connes, Yverdon-les-Bains (CH); Gilles Demaurex, Carlisle Cumbria (GB); Philippe Domansky, Mollens (CH); Thierry Fabozzi, Geneva (CH); Stephane Hentzel, Yvonand (CH); XiaoFeng Lan, Pully (CH); Raphael Thivolet, Beijing (CN)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 14/367,641

(22) PCT Filed: Dec. 17, 2012

(86) PCT No.: PCT/EP2012/075842
§ 371 (c)(1),
(2) Date: Jun. 20, 2014

(87) PCT Pub. No.: WO2013/092518
PCT Pub. Date: Jun. 27, 2013

(65) Prior Publication Data

US 2015/0210449 A1 Jul. 30, 2015

(30) Foreign Application Priority Data

Dec. 21, 2011 (EP) ..... 11195022

(51) Int. Cl.
*B65D 51/20* (2006.01)
*B67B 3/00* (2006.01)

(52) U.S. Cl.
CPC ..... *B65D 51/20* (2013.01); *B67B 3/00* (2013.01); *B65D 2251/0015* (2013.01);
(Continued)

(58) Field of Classification Search
CPC ..... B65D 51/20; B65D 2251/0015; B65D 2251/0093; B65D 2577/2058; B65D 2577/205; B67B 3/00; Y10T 29/49826
(Continued)

(56) References Cited

U.S. PATENT DOCUMENTS 5,176,271 A * 1/1993 Painchaud ..... B65D 51/20 215/232
5,514,442 A 5/1996 Galda et al.
(Continued)

FOREIGN PATENT DOCUMENTS

| | | |
|---|---|---|
| EP | 0697345 | 2/1996 |
| EP | 1462381 | 9/2004 |
| WO | 2012172029 | 12/2012 |

OTHER PUBLICATIONS

Russian Office Action for Application No. 2014129852/12(048063), dated Dec. 28, 2016, 8 pages.

*Primary Examiner* — James N Smalley
(74) *Attorney, Agent, or Firm* — K&L Gates LLP

(57) ABSTRACT

The invention is directed to a cap (10) for receptacles (20) such as e.g. glass jars, comprising a cap base body (11) with a fixing means (13) for enabling the cap (10) to be removably attached on the receptacles (20), a backing layer (2) made from a deformable material, and a sealable, preferably heat-sealable membrane (3) not being glued to the backing layer (2), wherein both the backing layer (2) and the membrane (3) are retained inside the cap (10) via a retention portion (18) extending from an inner side wall (14) of the cap (10). The invention is further directed to a receptacle (20) having said cap (10) for closing it, and is also directed to a method for providing the cap (10) with a sealing element (1) and for providing said cap (10) onto the receptacle (20).

14 Claims, 5 Drawing Sheets

(52) U.S. Cl.
CPC ..... *B65D 2251/0093* (2013.01); *B65D 2577/205* (2013.01); *B65D 2577/2058* (2013.01); *Y10T 29/49826* (2015.01)

(58) Field of Classification Search
USPC ..... 220/359.1–359.4, 258.1, 258.2; 215/232, 215/349, 350
See application file for complete search history.

(56) References Cited

U.S. PATENT DOCUMENTS

| | | | |
|---|---|---|---|
| 5,637,396 | A | 6/1997 | Sato et al. |
| 2007/0007229 | A1 | 1/2007 | Yousif |
| 2008/0041810 | A1 | 2/2008 | Itoh et al. |
| 2009/0078671 | A1 | 3/2009 | Triquet et al. |
| 2012/0103988 | A1 | 5/2012 | Wiening |

* cited by examiner

CLOSURE CAP WITH A MULTILAYER SEAL DISK FOR RECEPTACLES

CROSS REFERENCE TO RELATED APPLICATIONS

The present application is a National Stage of International Application No. PCT/EP2012/075842, filed on Dec. 17, 2012, which claims priority to European Patent Application No. 11195022.6, filed Dec. 21, 2011, the entire contents of which are being incorporated herein by reference.

FIELD OF THE INVENTION

The invention relates to a cap for receptacles such as e.g. glass jars, a receptacle comprising said cap, a method for comprising the cap with a sealing element and a method for providing the cap onto the receptacle.

BACKGROUND OF THE INVENTION

It is well known to seal containers or receptacles like glass jars, e.g. for containing (dried and/or powdered) nutritional components such as coffee or spread, with a screwable or clippable plastic cap. In general, the opening of the receptacle is sealably closed by a membrane to hermetically seal the container before the initial opening. Further, a backing layer or support is provided inside the cap to absorb the tolerances between the bottom of the cap and the upper rim of the container. It is thus possible to achieve a certain sealing effect from the ambiance, especially against humidity, when the container is reclosed with the cap after the membrane has been opened/removed from the container. This comes about since the backing layer is pressed against the upper rim of the container.

A heat-sealable sealing element for closing a container having a cap closure is, for instance, known from EP 2 045 194 B1. The heat-sealable sealing element consists of a heat-sealable membrane placed on the whole periphery of the upper rim of the neck of the container or mouth, thereby isolating the container from the exterior, and on the other hand, of a generally thicker support or backing layer, inserted in the bottom of the cap. Prior to the initial opening of the container, particularly before inserting the sealing element in the cap, the support and the heat-sealable membrane are joined by means of a temporary adhesive. The relatively thick and stiff heat-sealable membrane is opened by the consumer not by punching or tearing, but rather by peeling it off from the upper rim of the container using a tab.

In practice, the sealing element is inserted at the bottom of the cap and retained therein via a retention bead of the cap. Once the container is filled, the cap provided with the sealing element is screwed or clipped to the container. The heat-sealable membrane of the sealing element is then in contact with the mouth. The heat-sealable membrane is then sealed to the mouth by induction heat-sealing. Upon opening the container for the first time, the support inserted at the bottom of the plug is detached from the heat-sealable membrane which remains sealed on the upper rim of the container. A temporary adhesive provided between the heat-sealable membrane and the support will be broken preferably by shearing as a result of the separation of the heat-sealable membrane sealed on the container and the support retained in the cap via the retention bead. As the heat-sealable membrane is made from a stiff material a relatively great opening torque (particularly when the cap is screwed to the container) or opening force (particularly when the cap is clipped to the container) is required when the user opens the container for the first time. This great opening torque or force is caused by the fact that at the time of the initial opening the relatively thick heat-sealable membrane has to pass the retention bead. Further, there is a risk that the heat-sealable membrane and support (or backing layer) stick together during an opening of the receptacle due to the temporary adhesive between the heat-sealable membrane and the support such that either the heat-sealable membrane is lifted from the receptacle thus exposing the product to the ambiance or the support is pulled out of the cap by passing the retention bead.

SUMMARY OF THE INVENTION

The present invention aims to improve on the above-mentioned drawbacks, and an object thereof is to provide a cap for sealing the rim of a receptacle as well as a receptacle which allow an easy and comfortable intended initial opening of the receptacle.

The object is to be accomplished by means of the independent claims. The dependent claims advantageously study further the central idea of the invention.

According to a first aspect of the invention, there is provided a cap for receptacles such as e.g. glass jars. Said cap comprises a cap base body with a fixing means like a screw thread (in the following also referred to as "thread") or a clipping means (e.g. a circumferential ring) for enabling the cap to be removably attached (e.g. screwed or clipped or the like) on the receptacles, a backing layer made from a deformable material, and a sealable, preferably heat-sealable membrane (in the following also referred to as "membrane") not being glued to the backing layer. Both the backing layer and the membrane are retained inside the cap via a retention portion extending from an inner side wall of the cap. Preferably, the retention portion radially extends from the inner side wall of the cap thus forming a retention bead, preferably a ring-shaped or circumferential retention bead.

The invention thus provides a cap for receptacles like glass jars, by means of which a sticking of the backing layer to the membrane can be securely avoided. Therefore, a glue or other temporary adhesive films or layers between the backing layer and the membrane are omitted. It is thus possible to handle the backing layer and the membrane separately and to easily remove the cap from the receptacle when initially opening the latter while the risk that these two members of the sealing element (i.e. backing layer and membrane) stick together is eliminated. Hence, when opening the receptacle, the backing layer being retained by the retention portion will remain inside the cap and the membrane will remain on the receptacle to which it is sealably connected as will be described herein.

Preferably, the membrane comprises an additional or integral opening means such as e.g. an opening tab or opening lid being connected to the membrane, preferably at a rim portion of the membrane, or being part of the membrane structure. The opening means or tab preferably is positioned between the backing layer and the membrane. Such an opening tab or lid allows an easy opening of the receptacle as the membrane sealed on the rim of the receptacle can be easily removed by pulling at the opening tab or lid. The membrane will then easily be peeled off the upper rim and will, for instance, not break in a slot-like opening.

In a preferred embodiment, the backing layer and the membrane are free in rotation with respect to each other when being retained inside the cap. In other words, there is no connection provided between the sealing element members such that a sticking between these members can be securely eliminated. However, the sealing element members, i.e. the backing layer and the membrane, may comprise a temporary mechanical connection as long as they are not glued or otherwise provided with an adhesive film or layer.

As the backing layer and the membrane can be handled separately, they can now have different dimensions. Particularly, the membrane can be smaller in dimension than the backing layer; preferably the diameter of the membrane is smaller than the diameter of the backing layer. Hence, an undesired high opening torque or force can be reduced in that an overhanging (surface) area or overhanging portion of the membrane required for initially retaining the membrane in the cap via the retention portion is reduced. This not only leads to a reduction of the opening torque or force but also to saving of materials. It has been found that a reduction by 50% of the overhanging area of the membrane which interacts or is engaged with the retention portion leads to a reduction of the opening torque or force of the initial opening of the cap of approximately 25%. Hence, while the dimensions of the membrane lead to a reduction of the opening torque, the membrane is still designed such that it can be securely retained in the cap via the retention portion. It is thus possible to provide a sealing element which can be securely retained in a cap during the mounting of the cap on a receptacle and the sealing of the membrane to the upper rim of the container or receptacle, while an initial opening of the cap is made more comfortable for the user without a degradation in the sealing effect of the cap. To allow a sufficient reduction of the opening torque or force, the ratio between the diameter d of the membrane and the diameter D of the backing layer is preferably defined by the equation $$0.9 \leq d/D \leq 0.99,$$

preferably $0.94 \leq d/D \leq 0.97$.

The maximum difference in diameter between the membrane and the backing layer is preferably less than twice the radial width of the retention portion. Hence, the area of the membrane being engaged by the retention portion can be reduced thus leading to a reduced opening torque or force of the cap while a secure retention of both the sealing element members is attained at the same time. Both the diameter of the backing layer and the diameter of the membrane are preferably each greater than the diameter of the inner circumferential edge of the retention portion to allow a secure retention of the sealing element via the retention portion.

The backing layer is preferably made from foaming materials like expanded plastics such as polyethylene (EPE) or polypropylene (EPP), or is made from cardboard. Preferably, the backing layer is made up of two high-density polyethylene (HDPE) layers sandwiching an expanded polyethylene (EPE) layer.

The membrane may comprise a diffusion barrier layer preferably made of or comprising aluminum. In a preferred embodiment, the membrane is made up of a stiff material compound, comprising a heat-sealable layer preferably made of polyethylene (PE), polypropylene (PP) or polyester, a diffusion barrier layer preferably made of aluminum, and a reinforcing layer preferably made of plastics, preferably polyester like polyethylene terephthalate (PET).

According to a second aspect of the invention, there is provided a receptacle such as e.g. a glass jar for containing nutritional products. The receptacle has a cap according to the invention. The cap is removably attached onto an opening of the receptacle via its fixing means (e.g. thread or clipping means or the like) being engaged with a correspondent fixing means (e.g. thread or clipping means or the like) of the receptacle provided at its outer side wall such that the membrane rests on and is sealed to an upper rim of the receptacle enclosing its opening. The membrane is pressed towards the upper rim by means of the backing layer. Preferably, the membrane at least partially radially extends beyond the outer circumference of the upper rim of the receptacle.

According to a third aspect of the invention, there is provided a method for providing a cap for receptacles such as e.g. glass jars with a sealing element. Said method comprises the steps of: (a) placing a backing layer made from a deformable material in the cap such that the backing layer is retained inside the cap via a retention portion radially extending from an inner side wall of the cap, and (b) placing a sealable, preferably heat-sealable membrane in the cap such that the membrane is retained inside the cap via the retention portion and placed between the backing layer and the retention portion. The backing layer and the membrane are either handled together and placed in the cap in one step or handled separately and placed in the cap in two successive steps.

According to a fourth aspect of the invention, there is provided a method for providing a cap onto a receptacle such as e.g. a glass jar for containing nutritional products. Said method comprises the steps of: (a) placing a backing layer made from a deformable material in the cap such that the backing layer is retained inside the cap via a retention portion radially extending from an inner side wall of the cap, (b) placing a sealable, preferably heat-sealable membrane in the cap such that the membrane is retained inside the cap via the retention portion and placed between the backing layer and the retention portion, (c) removably attaching, preferably screwing or clipping the cap onto an opening of the receptacle filled with the nutritional product such that the membrane rests on an upper rim of the receptacle enclosing its opening, wherein the membrane is pressed towards the upper rim by means of the backing layer, and (d) sealing the membrane to the upper rim of the receptacle, preferably via induction welding or induction heat-sealing or by making use of an adhesive which is preferably applied to the membrane before step (d) (and step (c)). Regarding steps (a) and (b), the backing layer and the membrane are either handled together and placed in the cap in one step or handled separately and placed in the cap in two successive steps.

Further features, advantages and objects of the present invention would come apparent for the skilled person when reading the following detailed description of embodiments of the present invention, when taking in conjunction with the figures of the enclosed drawings.

DETAILED DESCRIPTION OF THE INVENTION

Figure 1A:
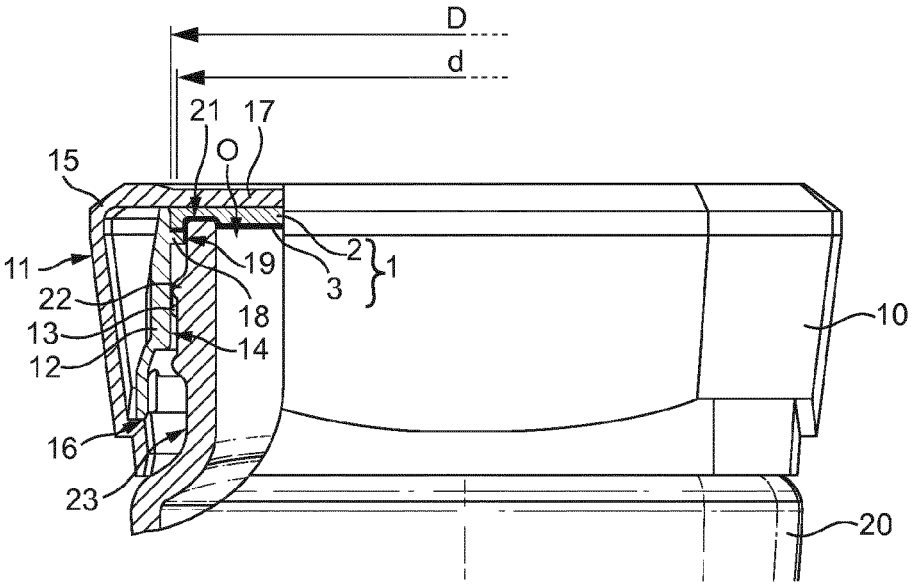
FIG. 1 shows a partially cut side view of an upper portion of two embodiments of a receptacle being closed by a cap according to the invention.
Figure 1B:
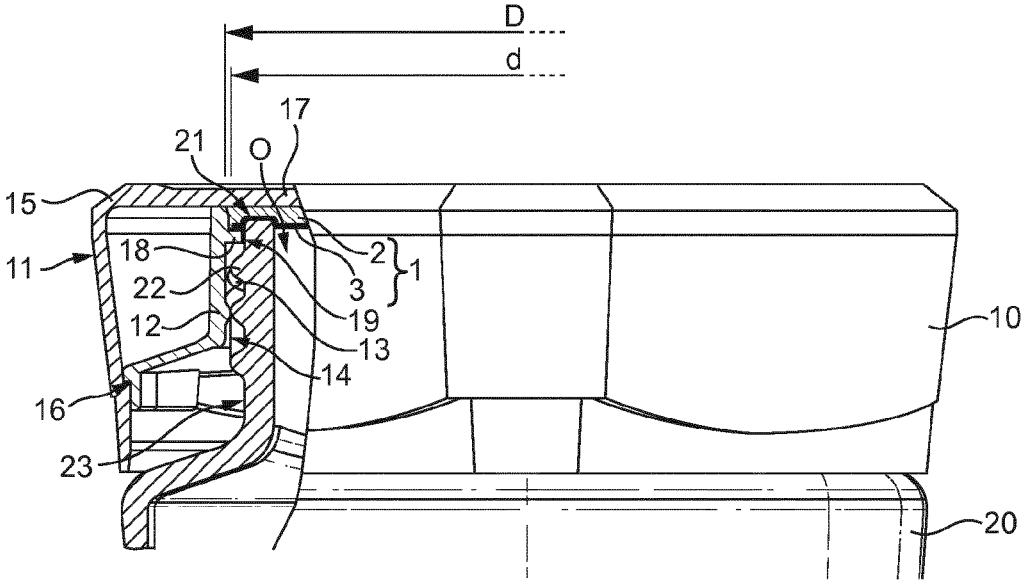
Figure 2A:
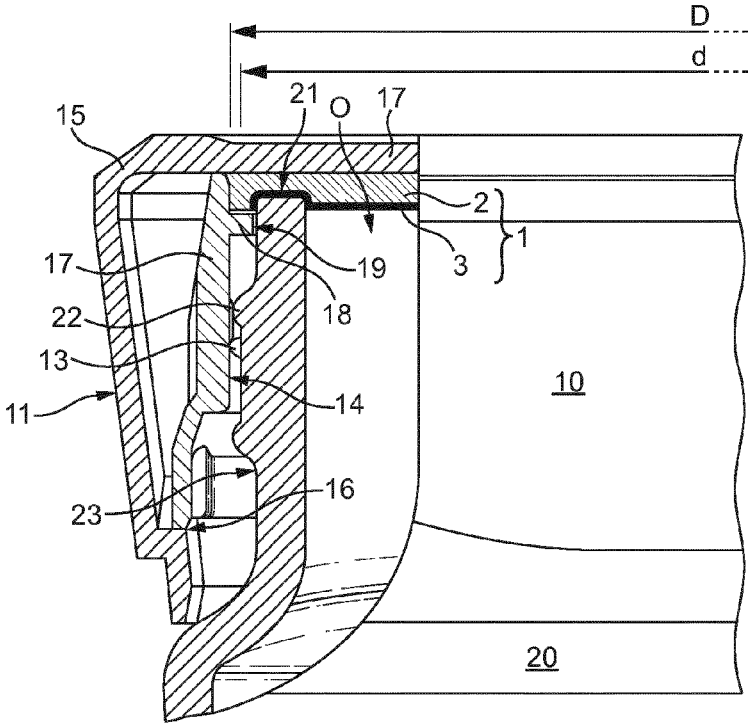
FIG. 2 shows an enlarged view of the partially cut portions of the two embodiments of the receptacle and cap of FIG. 1.
Figure 2B:
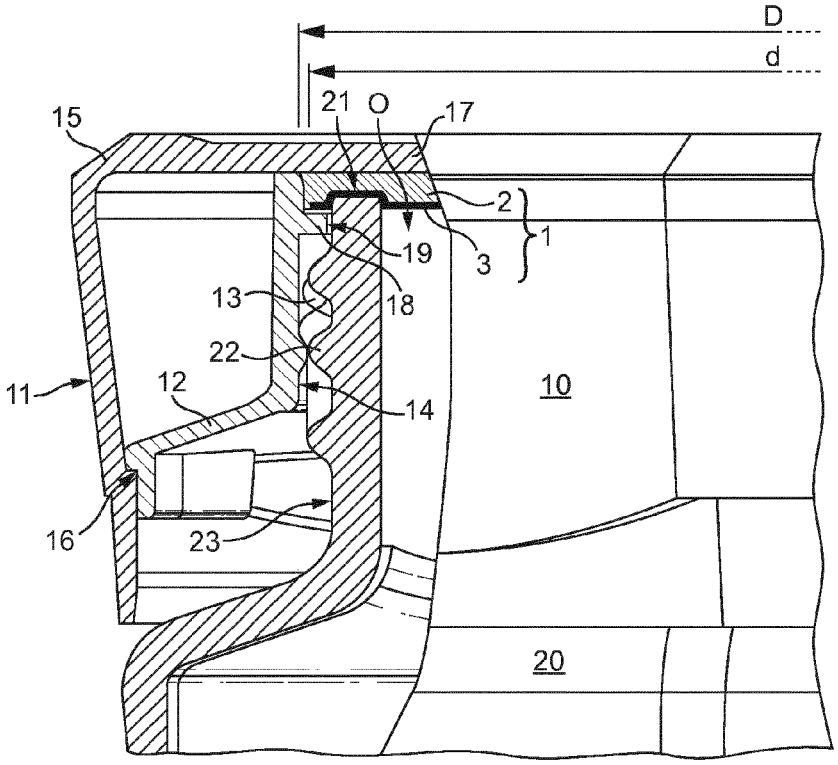

FIGS. 1 and 2 each show two embodiments of a cap 10 according to the invention being provided on or better removably attached onto a receptacle or container 20 before an initial opening thereof. The receptacle 20 can be a glass jar for containing (dried and/or powdered) nutritional products like coffee (beans or powder) or spread or the like but is not limited to these kinds of receptacles.

The cap 10 is intended to close an opening O of the receptacle 20 preferably in a sealable manner. The cap 10 comprises a cap base body 11 which is preferably made of plastics. The cap base body 11 can be integrally formed as a single piece member, or it can comprise a plurality of members being assembled to form the cap 10. In the latter case and as shown in FIGS. 1 and 2, the cap base body 11 may comprise an inner body 12 comprising a fixing means 13 like a screw thread (see FIGS. 1 to 4) or clips (not shown) or the like on its inner side wall 14 (identical with the inner side wall of the cap 10) for screwing/clipping/fixing the cap 10 onto the receptacle 20. Said inner body 12 can be inserted in and held by an outer (aesthetic) body 15 via an assembly structure 16. The fixing means 13 (e.g. screw thread or clipping means) on the inner side wall 14 of the single-part or multi-part cap or cap base body 11 is intended to engage with a correspondent fixing means 22 like a screw thread (see FIGS. 1 to 4) or a clipping means (not shown) or the like of the receptacle 20 being provided at its outer side wall 23 close to the upper rim 21 bordering the opening O for removably attaching the cap 10 onto the receptacle 20.

The cap 10 may further comprise a backing layer 2 and a sealable, preferably heat-sealable membrane 3 (in the following also referred to as "membrane"), the preferred structure of which will be described herein with respect to FIG. 5. The entirety of backing layer 2 and membrane 3 can also be referred to as "sealing element 1" and the backing layer 2 and the membrane 3 can also be referred to as "sealing element members" herein.

The membrane 3 is intended to hermetically seal the receptacle 20 such that the product remains fresh over a long time, e.g. during transport and storage. Therefore, the membrane 3 preferably comprises a diffusion barrier layer 301 preferably made of or at least comprising aluminum. The membrane 3 can be removed from the receptacle 20 to allow access to the product.

The backing layer 2 is intended to absorb the tolerances between a bottom 17 of the cap 10 or cap outer body 15 and the upper rim 21 of the receptacle 20. Once the receptacle 20 has been opened and the membrane 3 has been removed from the receptacle 20, a secondary tightness effect, especially against humidity, is achieved by the backing layer 2 when reclosing the receptacle 20 with the cap 10. Therefore, the backing layer 2 is made from a deformable material 200, preferably from foaming materials like expanded plastics such as polyethylene (EPE) or polypropylene (EPP), or it is made from cardboard or the like. The backing layer 2 may be glued or otherwise connected or adhered to the bottom 17 of the cap 10.

Figure 5:
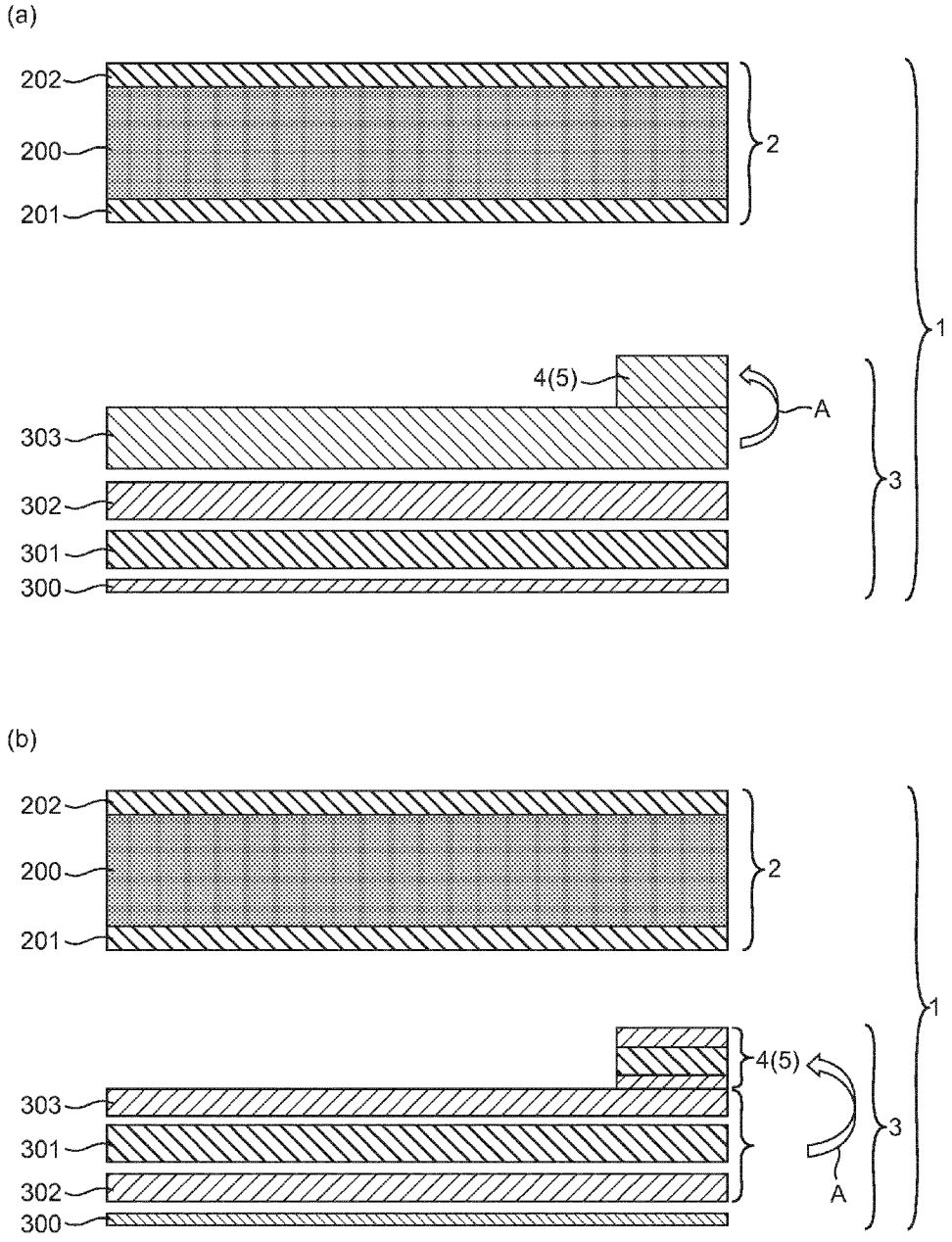
FIG. 5 shows a schematic view of two embodiments of the layered structure of the sealing element according to the invention; i.e. the sealing element members namely the backing layer and the sealable membrane.

FIG. 5 shows two preferred embodiments of the (layered) structure of the sealing element 1. The backing layer 2 in both FIGS. 5*a* and 5*b* comprises the above-mentioned deformable material 200 preferably made of an expanded plastic or cardboard which is provided on at least one of its two faces with a (comparably thin) layer 201, 202 (e.g. made of polypropylene (PP) or polyethylene (PE) like high-density polyethylene (HDPE)).

The membrane 3 can be made up of a more (FIG. 5*a*) or less (FIG. 5*b*) stiff material compound. With respect to FIG. 5*a*, the membrane 3 comprises a heat-sealable layer 300 preferably made of polyethylene (PE), polypropylene (PP) or polyester. By means of said heat-sealable layer 300, the membrane 3 can be sealed onto the rim 21 of the receptacle 20 as will be described herein. Further, the membrane 3 according to FIG. 5*a* comprises a diffusion barrier layer 301 preferably made of aluminum. The heat-sealable layer 300 and the diffusion barrier layer 301 can be joined by means of a binder, or the diffusion barrier layer 301 is coated with the heat-sealable layer 300. Moreover, the membrane 3 may comprise at least one reinforcing layer 302, 303 which is preferably made of plastics, preferably polyester like polyethylene terephthalate (PET). In FIG. 5*a*, two reinforcing layers 302, 303 are superposed and joined to the diffusion barrier layer 301, preferably by means of a binder or by coating. In particular, a first reinforcing layer 302 is joined to the diffusion barrier layer 301 on a face thereof being opposite to the heat-sealable layer 300, while a second reinforcing layer 303 is joined to the first reinforcing layer 302 on a face thereof being opposite to the diffusion barrier layer 301 and the heat-sealable layer 300. In a preferred embodiment, the second reinforcing layer 303 being exposed to an outside (i.e. most distanced from the heat-sealable layer 300) can be printed to provide the membrane 3 with a brand name or a membrane opening instruction for the consumer or the like.

With respect to FIG. 5*b*, the membrane 3 is made of a less stiff material in comparison with the embodiment of FIG. 5*a*. In the embodiment of FIG. 5*b*, the heat-sealable layer 300 is joined to the first reinforcing layer 302. The diffusion barrier layer 301 is joined to the first reinforcing layer 302 on a face thereof being opposite to the heat-sealable layer 300. The second reinforcing layer 303 is joined to the diffusion barrier layer 301 on a face thereof being opposite to the first reinforcing layer 302 and the heat-sealable layer 300. The second reinforcing layer 303 can be printed.

It is noted that the sealing element 1, particularly the backing layer 2 and the membrane 3, is/are neither limited to the materials nor to the order of the layers as depicted in the enclosed embodiments of FIG. 5.

According to the invention, the membrane 3 is not glued to the backing layer 2 but they are preferably placed or assembled in the cap 10 separately. In a most preferred embodiment, the backing layer 2 and the membrane 3 are free in rotation with respect to each other when being retained inside the cap 10. In other words, there is no connection provided between the sealing element members 2, 3 such that a sticking between these members 2, 3 can be securely eliminated as an adhesive film or layer is missing. Even if an adhesive force of an adhesive layer provided between the sealing element members should be dimensioned such that the backing layer 2 and the membrane 3 remain connected during assembly of the sealing element 1 into the cap 10 and are detached once the cap 10 is initially removed from the receptacle 20, it is difficult to determine said force accurately due to complex inherent material characteristics and non-predictable outer influences such as e.g. temperature and humidity at the location/region of opening. This problem, however, is addressed by the cap according to the invention. In this regard, it is also possible that the sealing element members 2, 3, i.e. the backing layer 2 and the membrane 3, can comprise a temporary mechanical connection as long as they are not glued or otherwise provided with an adhesive film or layer. Such a mechanical connection can be attained, for instance, by structuring the surfaces of the sealing element members 2, 3 such that these structures may engage with each other for temporarily connecting the membrane 3 and the backing layer 2. As mentioned above, the backing layer 2 may be glued or otherwise fixedly connected or adhered to the bottom 17 of the cap 10; however, membrane 3 and backing layer 2 are not glued to each other.

Now again turning to FIGS. 1 and 2, the cap 10 comprises the backing layer 2 and the membrane 3, both of which are retained inside the cap 10 via a retention portion 18 extending from an inner side wall 14 of the cap 10. The retention portion 18 can be integrally formed with the cap 10. Preferably, the retention portion 18 radially extends from the inner side wall 14 of the cap 10 and thus forms a retention bead. In a preferred embodiment, the retention bead 18 extends over the whole circumference of the inner side wall 14 of the cap 10 thus forming a ring-shaped or circumferential retention bead. Before the initial opening of the receptacle 20, both the backing layer 2 and the membrane 3 are retained inside the cap 10 by the retention portion 18, i.e. their circumferential area or better overhanging portion is at least partially placed between the retention portion 18 and the bottom 17 of the cap 10.

The cap 10 comprising the sealing element 1 is removably attached onto the opening O of the receptacle 20 such that the membrane 3 rests on the upper rim 21 of the receptacle 20 enclosing its opening O. In this position, the membrane 3 is pressed towards the upper rim 21 by means of the backing layer 2 which in turn is supported by the bottom 17 of the cap 10. By means of induction heat-sealing or welding, the membrane 3 can then be sealed onto the upper rim 21 of the receptacle 20 filled with nutritional products to thus provide a hermetical seal for said product. Alternatively, it is also possible that the membrane 3 is provided with an adhesive (e.g. glue or the like) on a face opposite to the backing layer 2; i.e. a face intended to be attached to the upper rim 21 of the receptacle 20. The adhesive is applied onto the membrane 3 such that its adhesive covered area corresponds to the upper rim 21 surface of the receptacle; i.e. the surface area of the membrane 3 intended to be in contact with the upper rim 21 of the receptacle 20 once the cap 10 is attached to the receptacle 20 is covered with the adhesive for sealably attaching the membrane 3 onto the upper rim 21 of the receptacle 20 thus hermetically sealing the receptacle 20. With respect to the structure of the membrane 3 as shown in FIG. 5, the adhesive can either be applied onto the heat-sealable layer 300 or the heat-sealable layer 300 can be omitted and the adhesive is applied onto the diffusion barrier layer 301 (FIG. 5*a*) or the first reinforcing layer 302 (FIG. 5*b*) or any other layer facing the upper rim 21 of the receptacle 20.

Figure 3A:
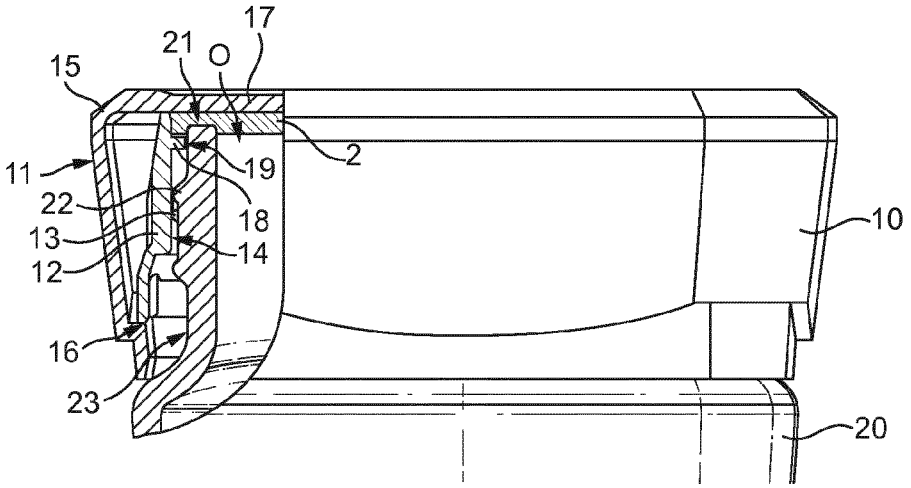
FIG. 3 shows the receptacles as shown in FIG. 1 after the membrane has been removed from the rim of the receptacle.
Figure 3B:
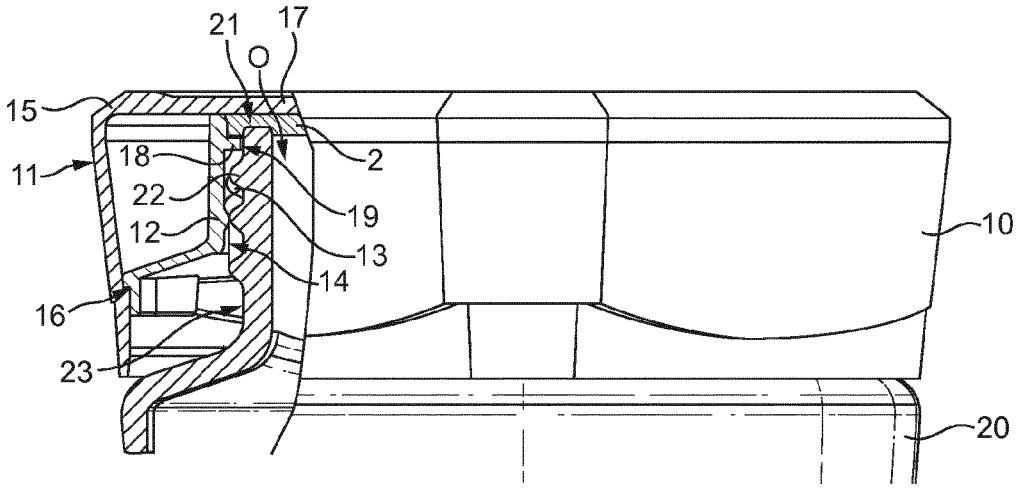
Figure 4A:
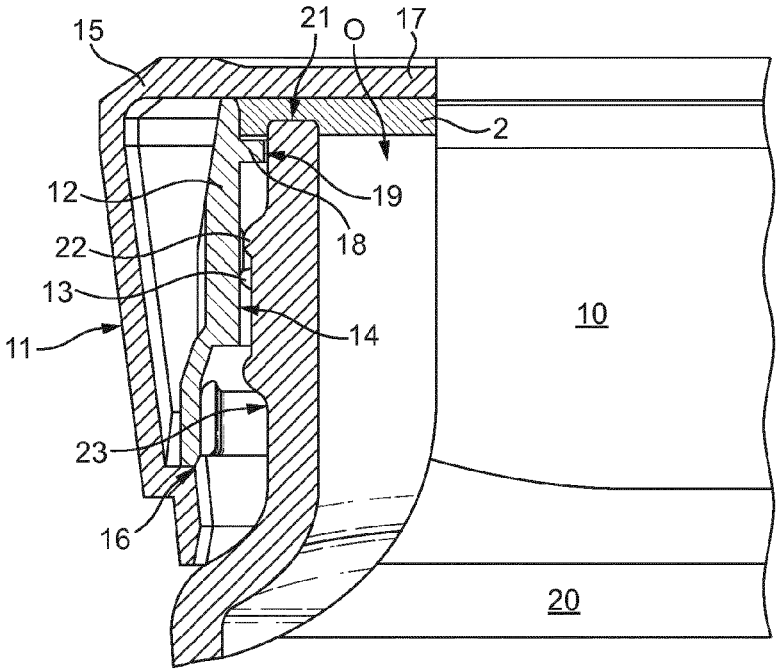
FIG. 4 shows an enlarged view of the partially cut portions of the two embodiments of the receptacle and cap of FIG. 3.
Figure 4B:
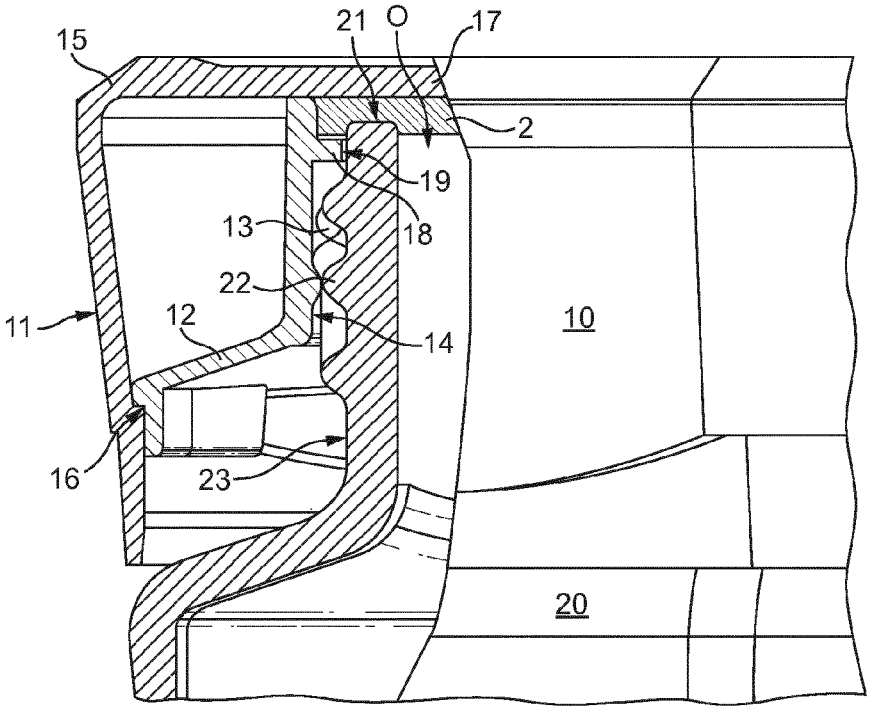

FIGS. 3 and 4 each show two embodiments showing the receptacles 20 as shown in FIG. 1 after the membrane 3 has been removed from the upper rim 21 of the receptacle 20. It can be clearly seen that the backing layer 2 is still retained inside the cap 10 via the retention portion 18. Due to its expanded and foamy structure, the backing layer 20 absorbing the tolerances between the bottom 17 of the cap 10 and the upper rim 21 of the receptacle 20 applies a certain sealing effect from the ambiance, i.e. a secondary tightness effect, especially against humidity, in the "reclosed" condition of the receptacle 20.

When initially opening the receptacle 20 by removing (e.g. unscrewing or unclipping) the cap 10, a relatively high opening torque or force is required since the membrane 3 being retained inside the cap 10 as can be seen in FIGS. 1 and 2 has to pass the retention portion 18. To reduce this opening torque or force and thus making the opening of the receptacle 20 much more comfortable for the consumer, the membrane 3 can be made smaller in dimension than the backing layer 2. For commonly used (substantially) circular sealing elements 1, this means that preferably the diameter of the membrane 3 is smaller than the diameter of the backing layer 2. By means of said diameter or dimension reduction of the membrane 3, the outer circumferential area of the membrane 3 which is retained by or engaged with the retention portion 18 can be (considerably) reduced. When now initially opening the receptacle 20 by removing/unscrewing/unclipping the cap 10, a much less circumferential surface area (i.e. overhanging portion) of the membrane 3 needs to pass the retention portion 18 such that the opening torque or force is reduced.

In a preferred embodiment, the maximum difference in diameter between the membrane 3 and the backing layer 2 is less than twice the radial width of the retention portion 18. This is because both the membrane 3 and the backing layer 2 shall be withheld by the retention portion 18. Preferably, the retention portion 18 has a width of 0.5 mm to 4 mm, more preferably 1 to 2 mm. It can also be similarly defined that the ratio between the diameter d of the membrane 3 and the diameter D of the backing layer 2 is defined by the equation $$0.9 \leq d/D \leq 0.99,$$

preferably $0.94 \leq d/D \leq 0.97$.

It is thus possible to reduce the membrane 3 diameter to allow for an easy and comfortable opening of the receptacle 20 due to a reduced opening torque or force while at the same time both the backing layer 2 and the membrane 3 can be securely retained inside the cap 10 via the retention portion 18, particularly before and during assembly of the cap 10 onto the receptacle 20. In this regard, the diameter of the backing layer 2 and the diameter of the membrane 3 are preferably each greater than the diameter of the inner circumferential edge 19 of the retention portion 18; thus each having an overhanging surface area or portion. Therefore, the membrane 3 at least partially needs to radially extend beyond the outer circumference of the upper rim 21 of the receptacle 20. It is noted that a reduction by 50% of the overhanging area of the membrane 3 which interacts with or is engaged by the retention portion 18 leads to a reduction of the opening torque or force of the initial opening of the cap 10 of approximately 25%. It is thus possible to provide a sealing element 1 which can be securely retained in a cap 10 during the mounting of the cap 10 on a receptacle 20 and the sealing of the membrane 3 to the upper rim 21 of the receptacle 20, while an initial opening of the cap 10 is made more comfortable for the user without a degradation in the sealing effect of the cap 10.

Additionally or alternatively to a reduction of the whole circumferential diameter of the membrane 3 with respect to the diameter of the backing layer 2, at least the membrane 3 of the sealing element 1 can also be contoured to reduce the overhanging surface area to be positioned between the bottom 17 and the retention portion 18 thus to reduce the opening torque or force as the overhanging area of the membrane 3 which has to pass the retention portion 18 is reduced. The membrane 3 thus may have a contour with a diameter continuously or stepwise or partially continuously and partially stepwise varying between a lower diameter value or lower radius value L and an upper diameter value or upper radius value U, i.e. the membrane 3 preferably has a corrugated or undulated or segmented or stepped or serrated (or another kind of contoured) outer circumference or contour such that the contour of the membrane 3 preferably alternately changes between the lower diameter/radius value L and the upper diameter/radius value U. The ratio between the lower diameter/radius value L and the upper diameter/radius value U can be defined by the equation $$0.9 \leq L/U \leq 0.99,$$

preferably $0.95 \leq L/U \leq 0.97$.

The width (i.e. the radial extension) of the retention portion 18 is preferably independent for a plurality of receptacles 20 of different sizes and thus different cap 10 sizes as can be seen in FIGS. 1 to 4. This comes about since the openings O of different sized receptacles 20 are usually identical. The difference in size can be compensated, e.g. by a different outer body 15 having outer dimensions adapted for the respective receptacle 20 sizes. Thus the absolute difference between the diameter of the membrane 3 and the backing layer 2, respectively, will be constant over a plurality of different receptacles 20 and cap 10 sizes.

Now turning again to FIG. 5, the membrane 3 may comprise an additional or integral opening means 4 which can be an opening lid connected to the membrane 3 or an opening tab 5 preferably connected to the rim portion of the membrane 3. In this case, the opening tab 5 is preferably positioned between the backing layer 2 and the membrane 3 preferably by being bent (see arrow A) from/around the rim portion of the membrane 3 to a centre portion thereof. The opening tab 5 is preferably arranged in an area of the membrane 3 which presents an overhanging area, i.e. extending beyond the upper rim 21 of the receptacle 20 when being sealed to said upper rim 21. In case the membrane 3 is contoured as described above, the opening tab 5 can be arranged in an area in which the contour of the membrane presents the upper diameter value U. When using the preferably integrally formed opening means 4 of the membrane 3 to open the receptacle 20, the membrane 3 can be easily peeled off the upper rim 21 of the receptacle 20 and will, e.g., not break in a slot-like opening.

In FIG. 5 it is shown that the opening means 4 can be integrally formed with the membrane 3 in that particular portions of particular layers of the membrane 3 extend over the intended rim portion thereof. The so formed strip like element (i.e. opening means 4 or tab 5) is then bent (see arrow A) about the rim portion of the membrane 3 to extend from the rim portion of the membrane 3 towards a centre portion thereof. Regarding FIG. 5*a*, the opening means 4 is made of an extended portion of the second reinforcing layer 303 which is thus made of a thicker material. In this case, the second reinforcing layer 303 of FIG. 5*a* can also be considered as opening lid having the opening tab 5. In FIG. 5*b*, the opening means 4 is made of an extended portion of a layered structure consisting of the reinforcing layers 302, 303 sandwiching the diffusion barrier layer 301 thus forming a strong opening means 4 though the respective layers are each thinner than the second reinforcing layer 303 of FIG. 5*a*. In this case, the compound of the reinforcing layers 302, 303 and the diffusion barrier layer 301 of FIG. 5*b* can also be considered as opening lid having the opening tab 5. As the opening means 4 or opening tab 5 is preferably made of or at least comprises portions of the reinforcing layers 302, 303, and is thus integrally formed with the membrane 3, a tearing of said opening means 4 or tab 5 or an undesired opening path (e.g. an undesired slot-like opening) of the membrane 3 can be avoided.

In the following, the assembly of the cap 10 including the mounting of a sealing element 1, the mounting of the cap 10 to the receptacle 20 as well as the removal of the membrane 3 will be described.

The backing layer 2 and the membrane 3 are produced. The membrane 3 is not glued to the backing layer 2. The cap 10 is also produced, e.g. by injection molding. In case the cap base body 11 comprises a plurality of parts, these parts are then assembled. According to the embodiment, the inner body 12 is inserted in and fixed to the outer body 15 by aid of the assembly structure 16. The backing layer 2 and the membrane 3 are then inserted in the cap 10, particularly at the bottom 17 thereof such that the sealing element 1, i.e. both the backing layer 2 and the membrane 3 are retained inside the cap 10 via the retention portion 18. To do so, the backing layer 2 is placed in the cap 10 such that the backing layer 2 is retained inside the cap 10 via the retention portion 18 radially extending from the inner side wall 14 of the cap 10, and then the membrane 3 is also placed in the cap 10 such that the membrane 3 is retained inside the cap 10 via the retention portion 18 and placed between the backing layer 2 and the retention portion 18. Alternatively, it is also possible that the sealing element members 2, 3 are placed on the retention portion 18 of the inner body 12 which is then inserted together with the sealing element members 2, 3 in the outer body 15 and fixed thereto via the assembly structure 16. In any case, the sealing element members 2, 3 can be inserted in the cap 10 separately or together; i.e. the backing layer 2 and the membrane 3 are either handled together and placed in the cap 10 in one step or handled separately and placed in the cap 10 in two successive steps. In any case, the membrane 3 and the backing layer 2 are not glued to each other.

The receptacle 20 is filled with a nutritional product and then the cap 10 is placed or better removably attached (e.g. screwed or clipped) onto the opening O of the receptacle 20 filled with the nutritional product; preferably, the cap 10 is removably attached onto the opening O of the receptacle 20 via its fixing means 13 preferably having a thread (see FIGS. 1 and 2) or clipping means being engaged with correspondent fixing means 22 (e.g. thread or clipping means) of the receptacle 20 provided at its outer side wall 23. In any case, the cap 10 is removably attached to the receptacle 20 such that the membrane 3 is in contact with and rests on the upper rim 21 of the receptacle 20 enclosing its opening O. In this state the backing layer 2 presses the membrane 3 against the upper rim 21 of the receptacle 20 as can be seen in FIGS. 1 and 2, thus promoting the sealing effect.

Thereafter, the membrane 3 is sealed to the upper rim 21 of the receptacle 21, preferably via induction heat-sealing or induction welding. The induction heat-sealing or welding allows a conducting material (e.g. the aluminum diffusion barrier layer 301 of the membrane) to heat under the effect of an electrical induction sealer, thus causing the softening of a sealing film (e.g. the heat-sealable layer 300 of the membrane 3) on the upper rim 21 of the receptacle 20, which sealing film 300 creates a bond with the upper rim 21 resulting in a hermetically sealed receptacle 20.

Alternatively, it is also possible that the membrane 3 is provided with an adhesive (e.g. glue or the like) on a face intended to be attached to the upper rim 21 of the receptacle 20. The adhesive is applied onto the membrane 3 before being attached to the upper rim 21 of the receptacle 20 in a way that the adhesive covered area corresponds to the upper rim 21 surface of the receptacle. Hence, the surface area of the membrane 3 intended to be in contact with the upper rim 21 of the receptacle 20 once the cap 10 is attached to the receptacle 20 is covered with the adhesive. When attaching the cap 10 with the sealing element 1 to the receptacle 20, the membrane 3 is sealably attaching onto the upper rim 21 of the receptacle 20 by means of the adhesive thus hermetically sealing the receptacle 20. When making use of such an adhesive, the step of removably attaching the cap 10 to the receptacle 20 comes along with the step of sealing the membrane 3 to the upper rim 21 of the receptacle 20 which thus occur simultaneously. This comes about since the thickness of the (foamy) backing layer 2 is preferably dimensioned such that it applies a force onto and thus presses the membrane 3 in a direction towards the upper rim 21 of the receptacle 20.

In this state, the membrane 3 and the backing layer 2 preferably remain free in rotation with respect to each other or relative to each other; at least they are still not glued to each other.

Upon opening of the receptacle 20 for the first time by removing (e.g. unscrewing or unclipping) the cap 10, the backing layer 2 being retained by the retention portion 18 is distanced from the membrane 3 which remains sealed on the rim 21. As the membrane 3 and the backing layer 2 are not glued to each other, a lifting of the membrane 3 thus unintentionally exposing the product to the atmosphere or the backing layer 2 being pulled out of the cap 10 by passing the retention portion 18 can be securely and effectively avoided.

When removing the cap 10, the membrane 3 still needs to pass the retention portion 18. An opening torque or force for doing so can be considerably reduced by reducing the outer circumferential area (i.e. overhanging portion) of the membrane 3 being retained by and engaged with the retention portion 18 in comparison to a membrane known from the prior art having a constant diameter identical to that of the backing layer. A reduction of the outer circumferential area of the membrane 3 can thus preferably be attained by a reduction of the diameter/radius of the membrane 3 thus being smaller than that of the backing layer 2 and/or by a continuously and/or stepwise varying diameter/radius of the membrane 3 as described above.

Once the cap 10 has been removed, the membrane 3 can be peeled off the rim 21 by grasping and pulling at the opening means 4, preferably defined by the opening tab 5 which is preferably positioned between the backing layer 2 and the membrane 3 when they are placed in the cap 10 and being exposed once the cap 10 has been removed from the receptacle 20.

When reclosing the receptacle 20 with the cap 10 as shown in FIGS. 3 and 4, i.e. after having opened and/or removed the membrane 3 from the receptacle 20, e.g. by aid of the opening tab 5, a secondary tightness effect, especially against humidity, is achieved by the backing layer 2 retained inside the cap 10 via the retention portion 18 as being pressed against the upper rim 21 of the receptacle 20.

The invention is not limited to the embodiments described in this application and all features of the embodiments can be combined in any possible way as long as being covered by the scope of the invention as given by the appended claims.

The invention claimed is:

1. A cap for closing a receptacle, the cap comprising:

a cap base body with a fixing member configured to enable the cap to be removably attached on the receptacle;

a backing layer made of a deformable material; and a sealable membrane that is not glued to the backing layer, both the backing layer and the sealable membrane are retained inside the cap by a retention portion extending from an inner side wall of the cap, and the sealable membrane is smaller in dimension than the backing layer.

2. The cap according to claim 1, wherein the sealable membrane comprises an additional or integral opening member.

3. The cap according to claim 1, wherein the backing layer and the sealable membrane are free to rotate with respect to each other when being retained inside the cap.

4. The cap according to claim 1, wherein a maximum difference in diameter between the sealable membrane and the backing layer is less than twice a radial width of the retention portion.

5. The cap according to claim 1, wherein a ratio between a diameter (d) of the sealable membrane and a diameter (D) of the backing layer is defined by $0.94 \leq d/D \leq 0.97$.

6. The cap according to claim 1, wherein both a diameter of the backing layer and a diameter of the sealable membrane are each greater than a diameter of an inner circumferential edge of the retention portion.

7. The cap according to claim 1, wherein the retention portion radially extends from the inner side wall of the cap thus forming a retention bead.

8. The cap according to claim 1, wherein the backing layer is made of a foaming material.

9. The cap according to claim 1, wherein the sealable membrane is made of a stiff material compound and comprises a heat-sealable layer.

10. The cap according to claim 1, wherein the retention portion is a ring-shaped retention bead.

11. A cap for closing a receptacle, the cap comprising:

a cap base body with a fixing member configured to enable the cap to be removably attached on the receptacle;

a backing layer made of a deformable material; and a sealable membrane that is not glued to the backing layer, both the backing layer and the sealable membrane are retained inside the cap by a retention portion extending from an inner side wall of the cap, and the sealable membrane comprises a diffusion barrier layer.

12. A receptacle having a cap for closing the receptacle, the cap comprising a cap base body with a fixing member configured to enable the cap to be removably attached on the receptacle, a backing layer made of a deformable material, and a sealable membrane that is not glued to the backing layer, the sealable membrane is smaller in dimension than the backing laver, both the backing layer and the sealable membrane are retained inside the cap by a retention portion extending from an inner side wall of the cap, the cap is removably attached onto an opening of the receptacle by a fixing member engaged with a correspondent fixing member of the receptacle provided at an outer side wall of the receptacle such that the sealable membrane rests on and is sealed to an upper rim of the receptacle enclosing the opening, and the sealable membrane is pressed towards the upper rim by the backing layer.

13. The receptacle according to claim 12, wherein the sealable membrane at least partially radially extends beyond an outer circumference of the upper rim of the receptacle.

14. The receptacle according to claim 12, wherein the sealable membrane comprises a diffusion barrier layer.

* * * * *